US005211535A

United States Patent [19]

Martin et al.

[11] Patent Number: 5,211,535

[45] Date of Patent: May 18, 1993

[54] LABYRINTH SEALS FOR GAS TURBINE ENGINE

[75] Inventors: Jeffrey C. Martin, Cincinnati; Robert J. Meade, West Chester, both of Ohio

[73] Assignee: General Electric Company, Cincinnati, Ohio

[21] Appl. No.: 814,161

[22] Filed: Dec. 30, 1991

[51] Int. Cl.[5] ..... F03B 11/00

[52] U.S. Cl. ..... 415/170.1; 415/174.4; 415/174.5; 277/53; 277/54; 277/229; 277/230

[58] Field of Search ..... 415/170.1, 174.4, 174.5, 415/229, 230; 277/53, 54

[56] References Cited

U.S. PATENT DOCUMENTS

| | | | |
|---|---|---|---|
| 2,543,615 | 2/1951 | Trumpler | 286/11 |
| 3,339,933 | 2/1965 | Foster | 277/53 |
| 4,103,899 | 8/1978 | Turner | 277/53 |
| 4,201,426 | 5/1980 | Garten et al. | 415/229 |
| 4,305,998 | 12/1981 | Manty et al. | 428/680 |
| 4,320,903 | 3/1982 | Ayache et al. | 277/53 |
| 4,378,197 | 3/1983 | Gattaneo et al. | 415/175 |
| 4,463,956 | 8/1984 | Malott | 277/12 |
| 4,623,297 | 11/1986 | Beam, Jr. | 415/170.1 |
| 4,662,821 | 5/1987 | Kervistin et al. | 415/174.5 |
| 4,756,536 | 7/1988 | Belcher | 277/53 |
| 4,979,755 | 12/1990 | Lebreton | 415/174.5 |

FOREIGN PATENT DOCUMENTS 1125392 11/1984 U.S.S.R. .

*Primary Examiner*—Richard A. Bertsch
*Assistant Examiner*—Mark Sgantzos
*Attorney, Agent, or Firm*—Jerome C. Squillaro; David L. Narciso

[57] ABSTRACT

A labyrinth seal for a gas turbine engine of the type having a high pressure compressor and high pressure turbine, an outer shaft interconnecting the high pressure compressor and turbine, a low pressure compressor and turbine, and an inner shaft interconnecting the low pressure compressor and turbine in which the shafts are concentric and are separated by the seal. The labyrinth seal includes a cylindrical sleeve which is discrete from and attached to the outer shaft, and which includes a plurality of annular seal teeth extending radially inwardly to the inner shaft. By placing the seal teeth on a sleeve which is discrete from the outer shaft and is easily replaceable, stress cracks created in the region of the seal teeth are prevented from propagating to the outer shaft and maintenance of the shafts is facilitated. Further, by configuring the seal teeth to extend, radially inwardly between two relatively rotating components, the fluid trapped by the seal is forced to take a tortuous path along the inner shaft; as a result, the seal of the present invention is more efficient at high temperatures and rotational speeds. The sleeve is captured between an annular rabbet at an aft end and radial slots formed on a seal tube the latter of which engage spaced, axially-extending fingers on the sleeve at the forward end of the sleeve. The sleeve is at a relatively low radius where mechanical deflections due to centrifugal loads of the two concentric shafts are similar. Deflection of the seal teeth is away from the inner shaft due to thermal effects in the concentric shafts.

12 Claims, 3 Drawing Sheets

LABYRINTH SEALS FOR GAS TURBINE ENGINE

The government has rights in this invention pursuant to contract No. F33657-83C-0281 awarded by the Department of the Air Force.

BACKGROUND OF THE INVENTION

The present invention relates to labyrinth seals and, more particularly, to labyrinth seals in gas turbine engines extending between two co-rotating or counterrotating components.

In gas turbine engines, it is frequently necessary to isolate a given volume, which is defined by one or more rotating parts, in order to confine a fluid within that volume or to prevent a fluid from flowing into that volume. For example, in a gas turbine engine, it is necessary to confine the liquid lubricant used for the shaft bearings to a volume immediately surrounding to the bearings, and at the same time to prevent excessive amounts of cooling air to flow into that volume of lubricating liquid.

Due to the high temperatures and relatively high rotational speeds of the components, often exceeding thousands of revolutions per minute, conventional contacting seals between relatively rotating components are inappropriate. Consequently, labyrinth seals, which comprise a plurality of spaced, radially-projecting seal teeth are used between two relatively rotating parts. Typically, the teeth are mounted on or are integral with one part and project toward the adjacent part with which the seal is to be formed, but do not contact that adjacent part to minimize friction and abrasion. An example of such a labyrinth seal is shown in Malott U.S. Pat. No. 4,463,956, which shows a labyrinth seal mounted on an outer, nonrotating component and extending radially inwardly toward a power transmitting shaft.

A particular problem exists when it becomes necessary to position a labyrinth seal between two corotating or counterrotating components, typically two concentric power-transmitting shafts within a turbine engine. Conventional practice dictates mounting the seal teeth on the inner shaft, since it is easier to machine seal teeth on a shaft outer diameter rather than on a shaft inner diameter. However, as a result of centripetal forces between the fluid isolated by the labyrinth seal and the contacting surface of the seal, the fluid is directed radially outwardly as well, where it passes through the gaps between the outer ends of the seal teeth and the adjacent rotating part, thereby reducing the efficiency of the seal.

Another disadvantage with known labyrinth seals is that the seal teeth have a relatively high susceptibility to stress cracking. Such stress cracks readily propagate to the component on which the teeth are formed, which can result in catastrophic failure of the component and require costly repair.

Accordingly, there is a need for a labyrinth seal designed for use between two co-rotating or counterrotating components in a gas turbine engine which does not transmit stress cracks to the component on which it is mounted and which effects a highly efficient seal.

SUMMARY OF THE INVENTION

The present invention is a labyrinth seal for use between two concentric, counterrotating or corotating components in which the seal effected is highly efficient as compared to prior art seals. Further, the labyrinth seal of the present invention is discrete from the component on which it is mounted so that stress cracks cannot propagate to that component, thereby reducing the likelihood of catastrophic failure of that component.

In a preferred embodiment of the invention, the labyrinth seal includes a cylindrical sleeve mounted on the outer shaft, which includes a plurality of spaced, radially inwardly extending seal teeth which project toward the inner shaft. The sleeve is captured between an annular rabbet formed on the outer shaft at an aft end, and a seal tube at a forward end having slots which receive axially projecting fingers extending forwardly from the sleeve. Accordingly, bolted connections between the sleeve and shaft are eliminated.

By providing radially inwardly projecting seal teeth, the fluid in the labyrinth seal, which is forced radially outwardly by frictional forces, is therefore forced against the base of the seal teeth as opposed to the gap at the ends of the seal teeth. Accordingly, the fluid trapped by the labyrinth seal is forced along a tortuous path as it progresses axially along the inner shaft, which reduces the rate of fluid leakage through the labyrinth seal and increases the efficiency of the seal.

Accordingly, it is an object of the present invention to provide a labyrinth seal which is easily replaceable and therefore minimizes maintenance costs; a labyrinth seal which is discrete from the rotating part on which it is mounted in order to prevent propagation of stress cracking; a labyrinth seal which is positioned between two co-rotating or counterrotating shafts and includes teeth which project radially inwardly in order to force the fluid entrapped by the seal to follow a tortuous path; and a labyrinth seal which is relatively easy to fabricate.

Other objects and advantages of the present invention will be apparent from the following description, the accompanying drawings and the appended claims.

DETAILED DESCRIPTION

Figure 1:
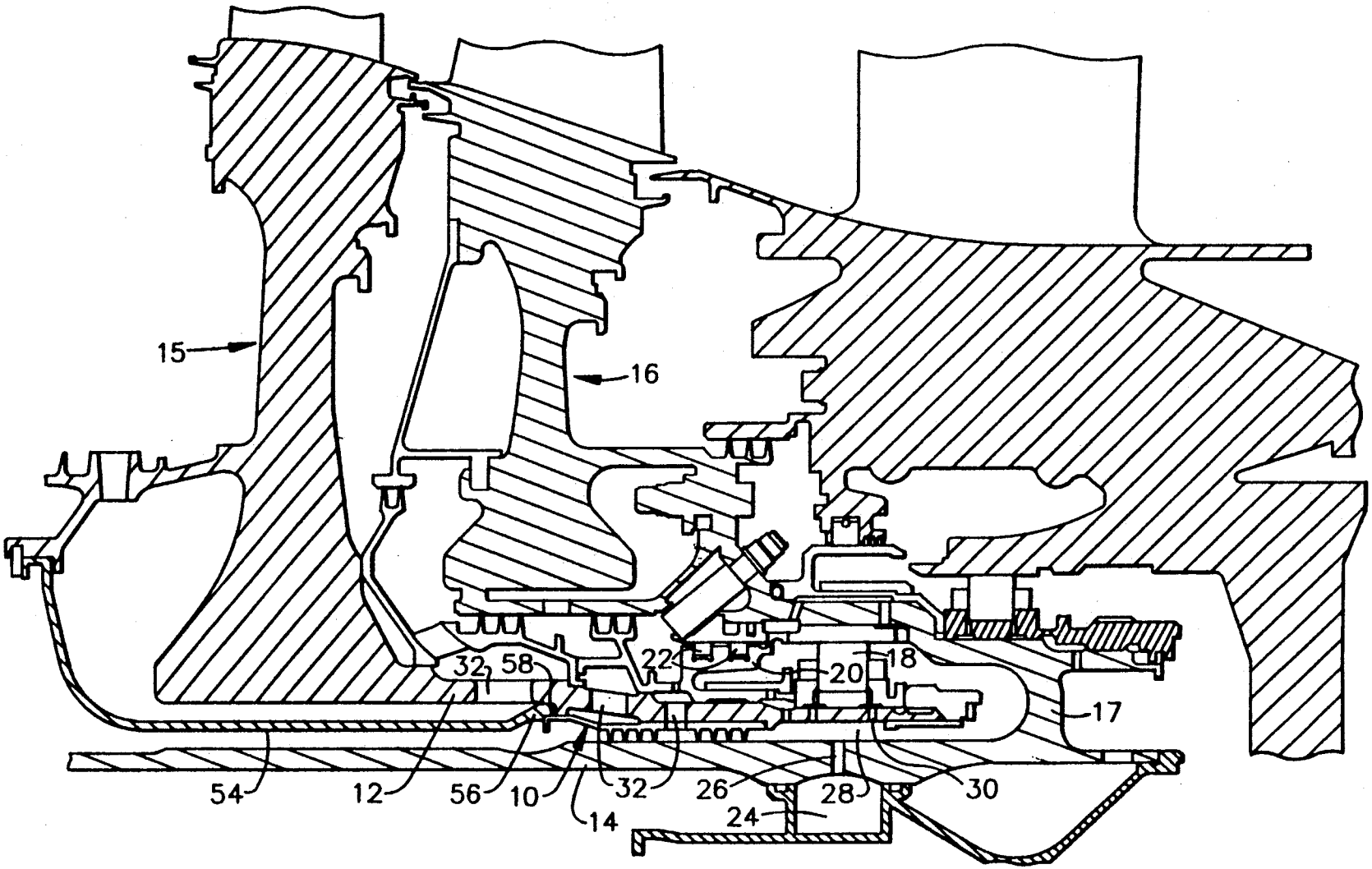
FIG. 1 is a somewhat schematic side elevation in section of a gas turbine engine showing two rotating shafts including the labyrinth seal of the present invention.

As shown in FIG. 1, the labyrinth seal of the present invention, generally designated 10, extends between the outer shaft 12 and inner shaft 14 of a gas turbine engine. In the engine shown, the outer shaft interconnects the high pressure compressor (not shown) and high pressure turbine 15, while the inner shaft interconnects the low pressure compressor (not shown) and low pressure turbine 16. Consequently, during operation of the engine, the two shafts will both rotate, but will rotate at differing speeds relative to each other.

The inner shaft 14 includes a component 17 which folds back on the shaft and is separated from the outer shaft 12 by a bearing 18. An oil seal 20 is mounted on the outer shaft 12 and includes oil seal rings 22 extending between the seal and the inner shaft portion 16. The inner shaft 14 defines an oil cavity 24 which includes radially extending channels 26 which allow oil in the cavity to flow radially outward to a bearing cavity 28. Radially extending channels 30, formed in the outer shaft 12, allow oil in the cavity 28 to flow radially outwardly to the bearing 18.

The outer shaft 12 includes a plurality of radially extending cooling air passages 32 which allow cooling air to flow into the space between the inner and outer shafts 14, 12 , respectively.

Figure 2:
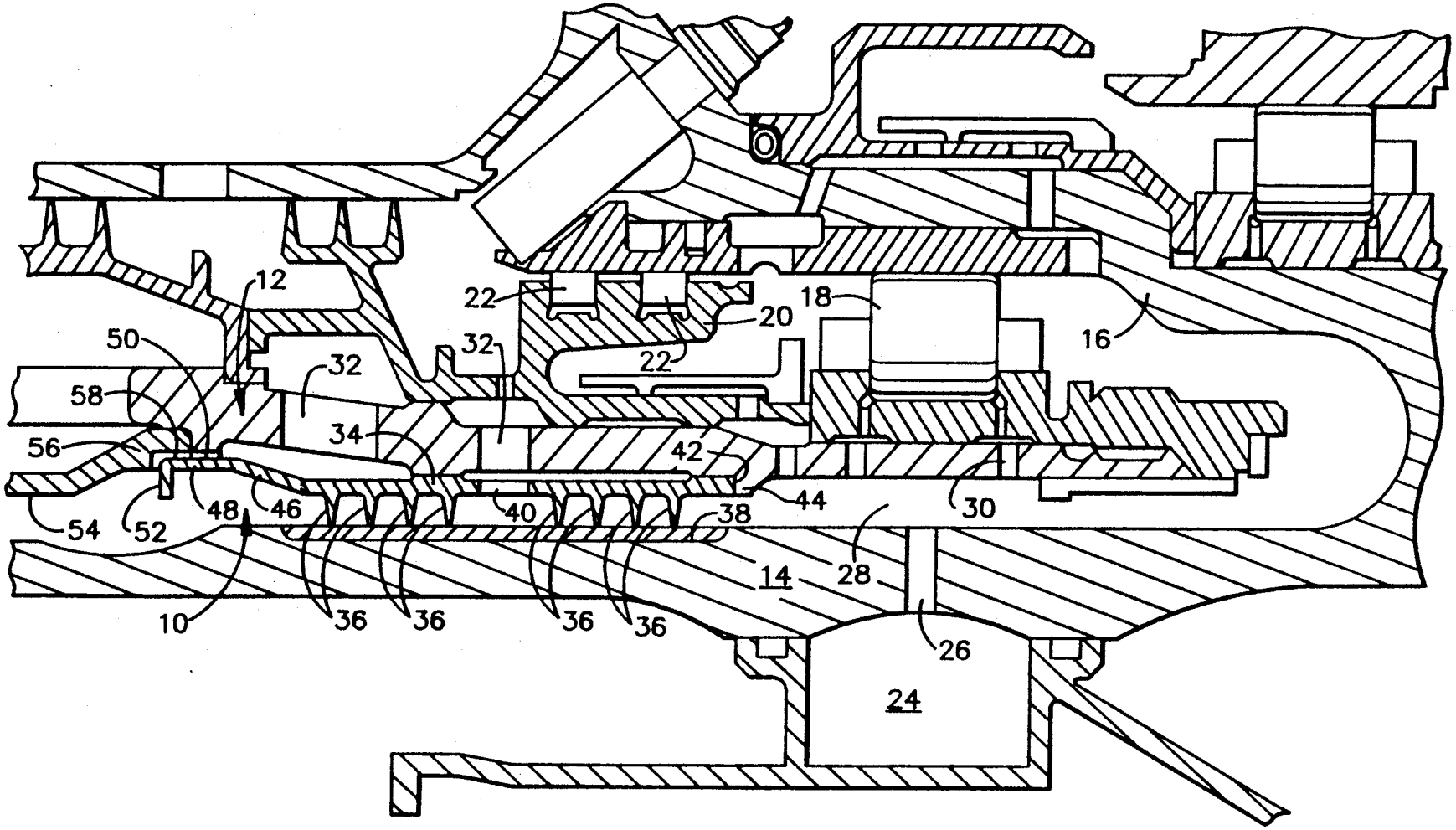
FIG. 2 is a detail of the side elevation of the engine of FIG. 1.
Figure 3:
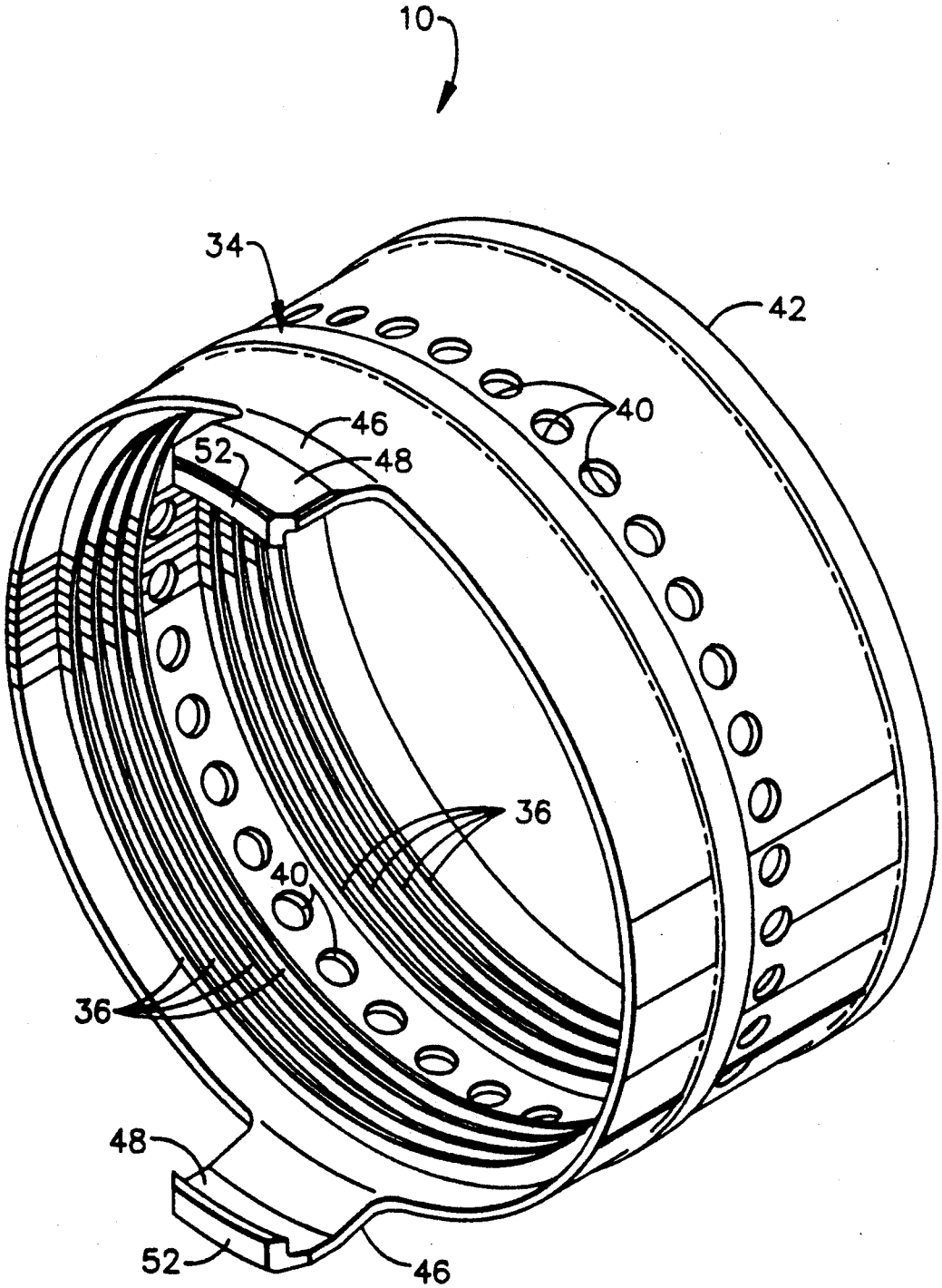
FIG. 3 is a perspective view of the seal of FIG. 1.

As shown in FIGS. 2 and 3, the labyrinth seal 10 includes a cylindrical sleeve 34 having a plurality of axially-spaced, radially inwardly extending annular seal teeth 36. The radially inner peripheries of the seal teeth 36 form gaps with the inner shaft 14 which are preferably approximately 0.01 inches (0.254 mm) at assembly. The inner shaft 14 includes a layer 38 of abrasion resistant material which is applied to the outer surface of the shaft in the area swept by seal teeth 36. A preferred material is nickel-graphite.

The sleeve 34 includes a plurality of orifices 40 which allow cooling air to enter between the sleeve 34 and the inner shaft 14 from the passages 32. The aft end 42 of the sleeve 34 abuts an annular rabbet 44 formed in the outer shaft 12. The forward end of the sleeve 34 includes a pair of frustoconical arms 46 terminating in axially-projecting fingers 48. The outer shaft 12 includes a pair of spaced recesses 50 which are positioned to receive the fingers 48 in locking engagement, thereby preventing the relative rotation between the sleeve 34 and outer shaft. The fingers 48 terminate in radially inwardly projecting flanges 52 which can be grasped by a tool to facilitate insertion and removal of the sleeve from between the outer and inner shafts 12, 14, respectively.

A cylindrical pressure tube 54, concentric with the inner shaft 14 and attached to the outer shaft 12, includes an aft end 56 which is shaped and positioned to abut the spaced recesses 50 of the outer shaft 12. The aft end 56 includes a pair of spaced slots 58 which receive the fingers 48 of the sleeve 34. Accordingly, the tube 54 prevents forward axial movement of the sleeve 34 relative to the outer shaft 12, so that the sleeve is captured between the aft end 56 and rabbet 44 of the outer shaft 12.

In operation, the outer and inner shafts 12, 14 will rotate at relatively high speeds, in excess of 10,000 rpm. Further, the rotational speeds of the shafts will be different under most operating conditions. As a result of the centrifugal forces applied to the seal 10, as well as the elevated temperatures of that area of the turbine engine, the sleeve 34 will deflect slightly outwardly, but outward deflection of the seal teeth, which would result in a widening of the gap formed with the inner shaft 14, will be negligible. The centrifugal forces applied to the fluid entering the space between the sleeve 34 and inner shaft 14 will cause the fluid to flow radially outwardly against the base of the seal teeth and sleeve 34, and away from the gaps formed between the seal teeth and inner shaft 14.

As pressure increases in the space between the sleeve 34 and shaft 14, the fluid follows a tortuous path rearwardly toward the oil volume 28. However, cooling air does flow into the volume 28 and mix with the oil in relatively small amounts, as controlled by the sizing of the seal gap. Oil in the volume 28 is prevented from flowing axially forwardly between the outer and inner shafts 12, 14 by the flow of air axially aft through the labyrinth seal 10.

In order to minimize the radial outward deflection of the labyrinth seal 10, the invention is best suited for shafts having a relatively small diameter, preferably systems in which the diameter of the sleeve 34 does not exceed 12 inches (30.48 cm). Further, since both components are rotating, radial outward deflections may tend to cancel out. Accordingly, in a preferred embodiment, the difference in rotational speeds between the inner and outer shafts should not exceed 50%. It should also be noted that, by placing the sleeve on an outer rotating part, the stresses and temperature of the sleeve are made uniform due to the rotation of the part which enhances the efficiency and performance of the seal over prior stationary seals.

While the form of apparatus herein described constitutes a preferred embodiment of this invention, it is to be understood that this invention is not limited to this precise form of apparatus, and that changes may be made therein without departing from the scope of the invention.

What is claimed is:

1. In a gas turbine engine of a type having an outer rotating shaft, an inner rotating shaft substantially concentric with said outer shaft, the improvement comprising:

a sleeve, attached to said outer shaft and having a plurality of radially-inwardly directed seal teeth projecting toward said inner shaft;

said sleeve including a plurality of spaced, forwardly-extending fingers; and said outer shaft including a plurality of recesses shaped to receive said fingers in a locking engagement, whereby rotation of said sleeve relative to said outer shaft is prevented.

2. The engine of claim 1 wherein said outer shaft includes tube means positioned forwardly of said sleeve, said tube means including a plurality of slots shaped to receive forward ends of said fingers, thereby preventing forward movement of said sleeve relative to said outer shaft.

3. The engine of claim 1 wherein said inner shaft includes a coating of abrasion-resistant material in registry with said seal teeth.

4. The engine of claim 3 wherein said coating is nickel-graphite.

5. The engine of claim 1 wherein said outer shaft includes an inner peripheral rabbet shaped to engage an aft end of said sleeve.

6. In a gas turbine engine of a type having an outer rotatable shaft and an inner rotatable shaft substantially concentric with said outer rotatable shaft, said inner and outer shafts rotating relative to each other, a labyrinth seal comprising:

means forming a seal between said inner and outer shafts, said seal means being mounted on said outer shaft for rotation therewith; and seal teeth means mounted on said seal means and projecting radially inward to form a seal with an outer surface of said inner shaft, whereby a tortuous path of axial fluid travel is formed between said inner and outer shafts.

7. The seal of claim 6 wherein said mounted means is discrete from said outer shaft.

8. The seal of claim 7 wherein said mounted means includes a sleeve concentric with said inner shaft.

9. The seal of claim 8 wherein said sleeve includes a plurality of spaced, forwardly-extending fingers; and said outer shaft includes a plurality of recesses, said recesses being shaped to receive said fingers therebetween in a locking engagement.

10. The seal of claim 6 wherein said sleeve does not exceed about 12 inches (30.48 cm) in diameter.

11. The seal of claim 6 wherein said inner shaft includes an abrasion resistant coating adjacent to said seal teeth means.

12. The engine of claim 11 wherein said coating is nickel graphite.

* * * * *